US011498012B2

(12) United States Patent
Hwang et al.

(10) Patent No.: US 11,498,012 B2
(45) Date of Patent: Nov. 15, 2022

(54) TRANSFORMABLE TOY VEHICLE HAULER

(71) Applicant: Mattel, Inc., El Segundo, CA (US)

(72) Inventors: Jung Jun Hwang, Inglewood, CA (US); Maxence Rodrigue Bilodeau, Marina Del Rey, CA (US); Yin Chak Wong, Hong Kong (CN)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 17/146,806

(22) Filed: Jan. 12, 2021

(65) Prior Publication Data

US 2022/0219095 A1 Jul. 14, 2022

(51) Int. Cl.
*A63H 17/00* (2006.01)
*A63H 17/05* (2006.01)
*A63H 18/02* (2006.01)

(52) U.S. Cl.
CPC ..... *A63H 17/008* (2013.01); *A63H 17/002* (2013.01); *A63H 17/05* (2013.01); *A63H 18/02* (2013.01)

(58) Field of Classification Search
CPC .... A63H 17/002; A63H 17/008; A63H 17/05; A63H 18/00; A63H 18/02
See application file for complete search history.

(56) References Cited

U.S. PATENT DOCUMENTS 3,786,597 A * 1/1974 Sano ..... A63H 17/05 446/443
4,286,752 A * 9/1981 Cheng ..... A63H 18/02 220/23.6
4,433,504 A 2/1984 Terui
4,505,686 A * 3/1985 Mariol ..... A63H 33/003 446/478
4,708,683 A * 11/1987 Lehmann ..... A63H 17/05 446/434
5,460,560 A * 10/1995 Liu ..... A63H 17/008 446/23
5,813,351 A * 9/1998 Chen ..... A63H 18/02 191/22 R
6,520,829 B1 2/2003 Temple
7,442,109 B2 * 10/2008 Fosbenner ..... A63H 17/08 446/451
8,668,081 B2 * 3/2014 Hippely ..... A63H 33/003 206/223
8,734,201 B2 5/2014 Nuttall et al.
(Continued)

FOREIGN PATENT DOCUMENTS

CN 206334341 U 7/2017
CN 206526511 U * 9/2017
(Continued)

*Primary Examiner* — Eugene L Kim
*Assistant Examiner* — Alyssa M Hylinski
(74) *Attorney, Agent, or Firm* — Edell, Shapiro & Finnan, LLC

(57) ABSTRACT

A transformable toy vehicle hauler comprises a trailer portion that includes three or more trailer sections pivotably coupled end-to-end. A cabin portion is connected to the trailer portion and includes a toy vehicle launcher. The toy vehicle hauler is capable of being configured in a transport configuration where the three or more trailer sections are folded together in a zigzag pattern and a raceway configuration where the three or more trailer sections are unfolded to form a straight track.

20 Claims, 4 Drawing Sheets

(56) References Cited

U.S. PATENT DOCUMENTS

| | | | | |
|---|---|---|---|---|
| 9,700,809 | B1 | 7/2017 | Harris et al. | |
| D852,901 | S | 7/2019 | Matsuyama | |
| 2008/0014832 | A1* | 1/2008 | Ostendorff | A63H 18/026 446/444 |
| 2012/0126022 | A1* | 5/2012 | Nuttall | A63H 18/04 280/47.17 |
| 2014/0256219 | A1* | 9/2014 | Lennon | A63H 17/008 446/429 |

FOREIGN PATENT DOCUMENTS

| | | | |
|---|---|---|---|
| CN | 206526511 | U | 9/2017 |
| CN | 207270713 | U | 4/2018 |
| CN | 210044853 | U | 2/2020 |

* cited by examiner

TRANSFORMABLE TOY VEHICLE HAULER

FIELD OF THE INVENTION

The present invention relates generally to toy vehicles, and in particular, auto transport trailers and haulers for toy vehicles.

BACKGROUND OF THE INVENTION

Toy vehicles have long been enjoyed by people of all ages. Numerous tracks, playsets, and accessories have been created to further enhance the enjoyment and play value of toy vehicles. One such accessory is a toy auto transport trailer or hauler that a child can use to store and transport multiple toy vehicles. While there are many toy vehicle haulers and transport trailers in the art, there is still a need for toy vehicle haulers with novel features that can stimulate new and creative play activities with toy vehicles.

SUMMARY OF THE INVENTION

A toy vehicle hauler is described herein that can transform between a transport configuration for storing and transporting toy vehicles and a raceway configuration that provides a track for toy vehicles to race along. In one or more embodiments, the transformable toy vehicle hauler comprises a trailer portion that includes three or more trailer sections pivotably coupled end-to-end. A cabin portion is connected to the trailer portion and includes a toy vehicle launcher. The toy vehicle hauler is capable of being configured in a transport configuration where the three or more trailer sections are folded together in a zigzag pattern and a raceway configuration where the three or more trailer sections are unfolded to form a straight track.

More specifically, while the toy vehicle hauler is in the transport configuration, the three or more trailer sections are stacked one on top of the other. While the toy vehicle hauler is in the raceway configuration, the three or more trailer sections are positioned linearly end-to-end. Furthermore, the cabin portion is connected to one of the trailer sections and the toy vehicle launcher is configured to launch one or more toy vehicles onto the trailer section connected to the cabin portion while the toy vehicle hauler is in the raceway configuration. In one or more instances, the cabin portion includes a pivotable actuator for activating the toy vehicle launcher.

In one or more further embodiments, the toy vehicle hauler comprises a trailer portion that includes two or more storage sections and one or more bridge sections. The two or more storage sections and the one or more bridge sections are pivotably coupled end-to-end in an arrangement that alternates between the storage sections and bridge sections. A cabin portion is further connected to the trailer portion and includes a toy vehicle launcher. The toy vehicle hauler is capable of being configured in a transport configuration where the alternating arrangement of storage sections and bridge sections are folded together in a zigzag pattern and a raceway configuration where the alternating arrangement of storage sections and bridge sections are unfolded to form a straight track.

In certain embodiments, each storage section includes a hollow space for storing toy vehicles and each bridge section includes a center support on an underside of the bridge section that helps support the bridge section when the toy vehicle hauler is in the raceway configuration. Furthermore, each storage section includes an opening on an underside of the storage section for receiving the center support of a bridge section while the toy vehicle hauler is in the transport configuration.

In yet another embodiment, the toy vehicle hauler comprises a trailer portion that includes three or more trailer sections pivotably coupled end-to-end. A cabin portion is connected to the trailer portion and includes a toy vehicle launcher configured to launch a toy vehicle onto one of the three of more trailer sections. The toy vehicle hauler includes rotatable wheels and is capable of being configured in a transport configuration and a raceway configuration. In the transport configuration, the three or more trailer sections are folded together one on top of the other in a zigzag pattern. In the raceway configuration, the three or more trailer sections are positioned linearly end-to-end to form a straight track.

Other objects, features and advantages of the present invention will become apparent to those skilled in the art from the following detailed description. It is to be understood, however, that the detailed description and specific examples, while indicating some embodiments of the invention, are given by way of illustration and not limitation. Many changes and modifications within the scope of the invention may be made without departing from the spirit thereof, and the present invention includes all such modifications.

BRIEF DESCRIPTION OF THE DRAWINGS

Referring now to the drawings in which like reference numbers represent corresponding parts throughout.

DETAILED DESCRIPTION OF THE INVENTION

Figure 1:
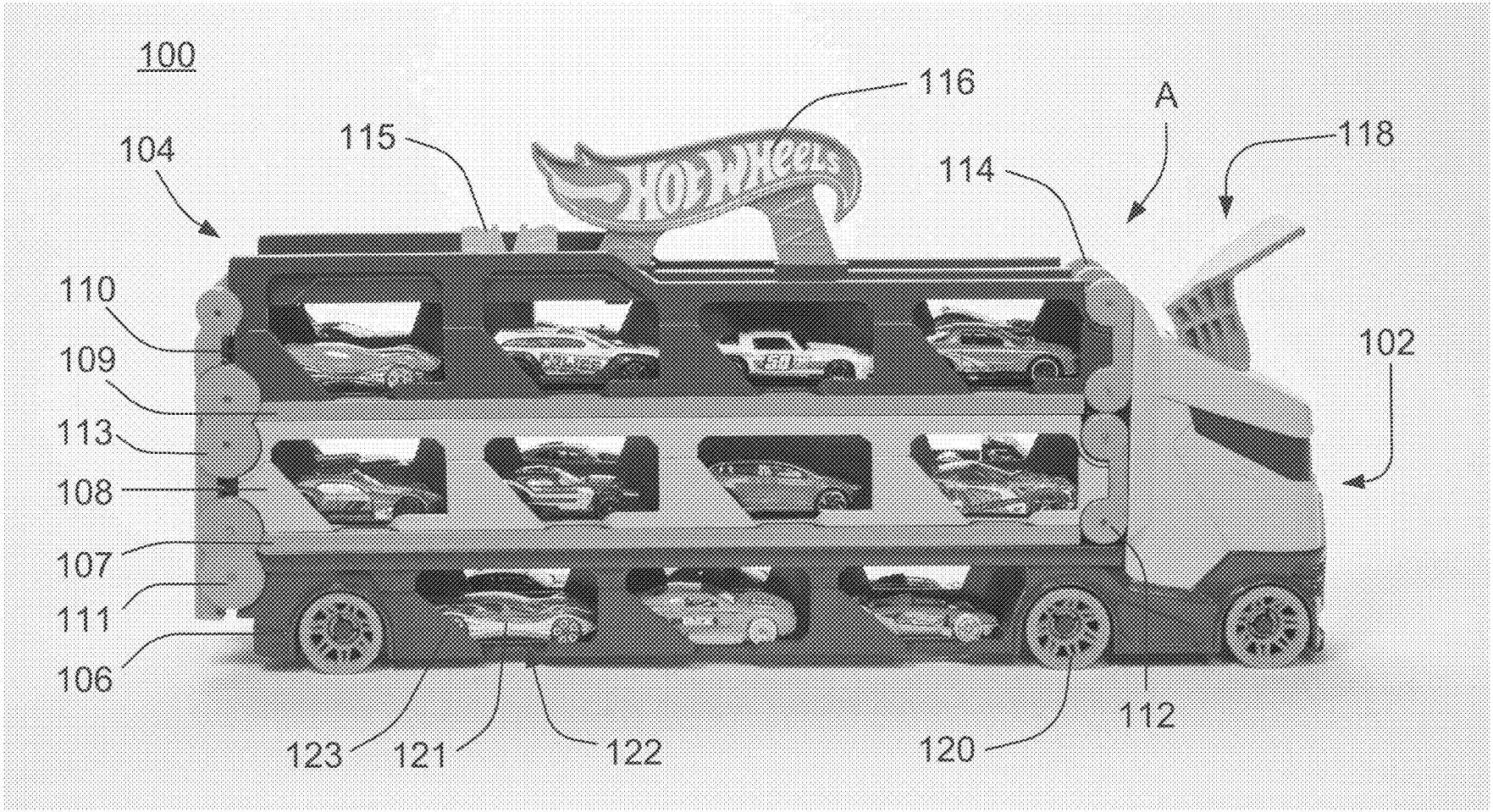
FIG. 1 illustrates a toy vehicle hauler in its transport configuration, in accordance with an embodiment of the invention.

A toy vehicle hauler that transforms into a raceway for toy vehicles is provided. FIGS. 1-4 set forth an illustrative example of the toy vehicle hauler and its transformation between its transport and raceway configurations. FIG. 1 shows a toy vehicle hauler 100 in a transport configuration A. Toy vehicle hauler 100 has a cabin portion 102 and a trailer portion 104 connected to the cabin portion 102. Wheels 120 are positioned on the bottom of cabin portion 102 and trailer portion 104, which allow toy vehicle hauler 100 to be rolled and pushed around. Trailer portion 104 comprises five trailer sections 106-110 that are pivotably coupled end-to-end via hinges 111-114.

More specifically, the five trailer sections 106-110 of trailer portion 104 consist of three storage sections 106, 108, 110 and two bridge sections 107, 109. Each storage section 106, 108, 110 has a hollow space for storing toy vehicles 121 and multiple openings 122 on the left and right sides of the storage section that provide access to the hollow space. The openings 122 are shaped with angular barrier walls 123 that help retain toy vehicles 121 within the storage sections, while still allowing toy vehicles 121 to be easily inserted and removed from the hollow space. In other embodiments, the trailer portion of the toy vehicle hauler comprises three or more trailer sections consisting of different combinations of storage and bridge sections. A minimum of three or more trailer sections is required so that the trailer sections can be folded into a zigzag pattern, as will be described in further detail below.

Storage sections 106, 108, 110 and the bridge sections 107, 109 are pivotably coupled end-to-end in an arrangement that alternates between the storage sections 106, 108, 110 and bridge sections 107, 109. In other words, one end of storage section 106 is pivotably coupled to one end of bridge section 107 via hinge 111, the other end of bridge section 107 is pivotably coupled to one end of storage section 108 via hinge 112, the other end of storage section 108 is pivotably coupled to one end of bridge section 109 via hinge 113, and the other end of bridge section 109 is pivotably coupled to one end of storage section 110 via hinge 114. The end-to-end coupling of trailer sections 106-110 allows trailer sections 106-110 to be folded together in a zigzag pattern or accordion-type fold while toy vehicle hauler 100 is in its transport configuration A. As shown in FIG. 1, storage sections 106, 108, 110 and bridge sections 107, 109 are stacked one on top of the other in an alternating arrangement that minimizes the space occupied by trailer sections 106-110.

Figure 2:
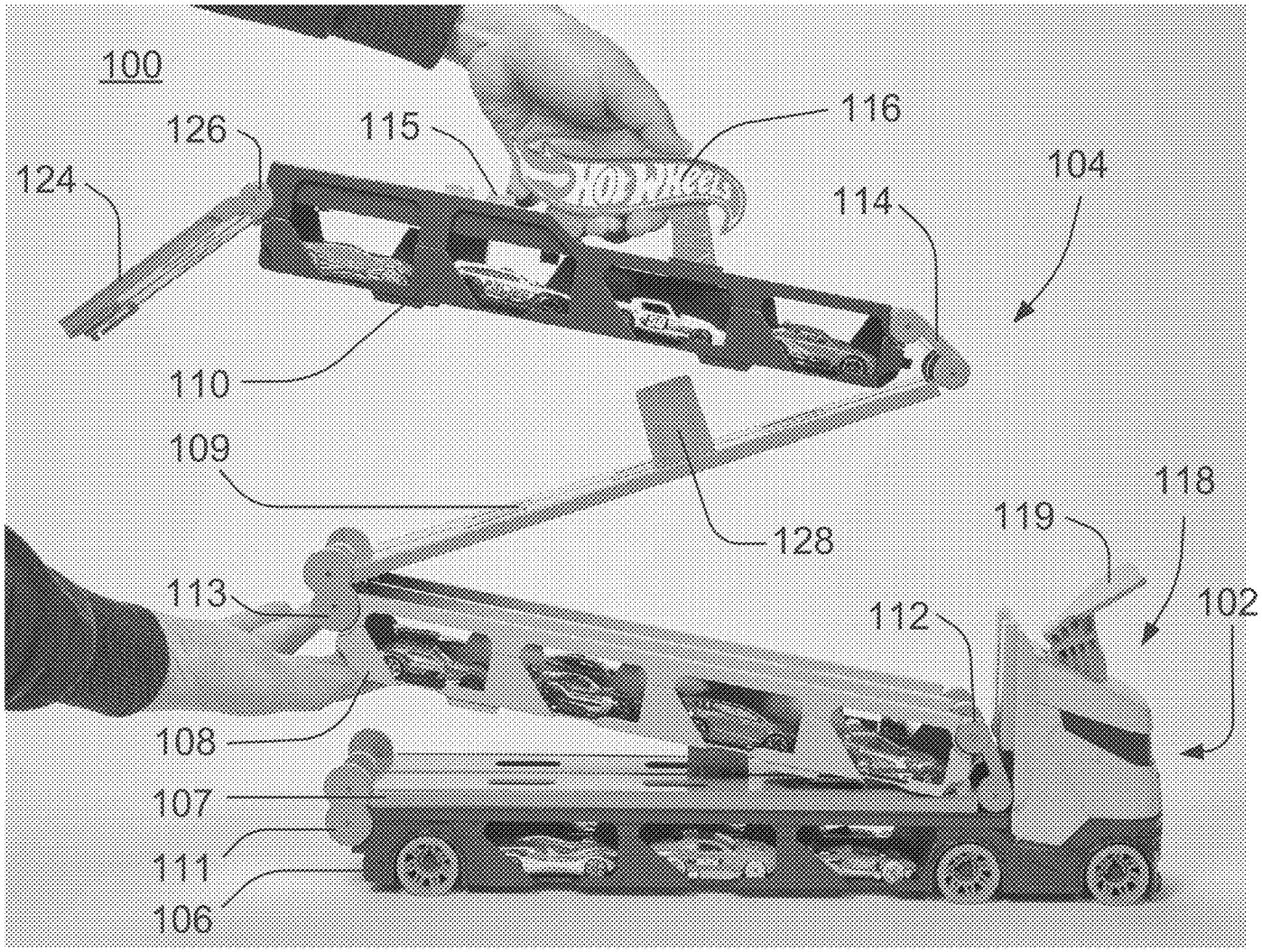
FIG. 2 illustrates the toy vehicle hauler of FIG. 1 in the process of transforming to its raceway configuration, in accordance with an embodiment of the invention.
Figure 3:
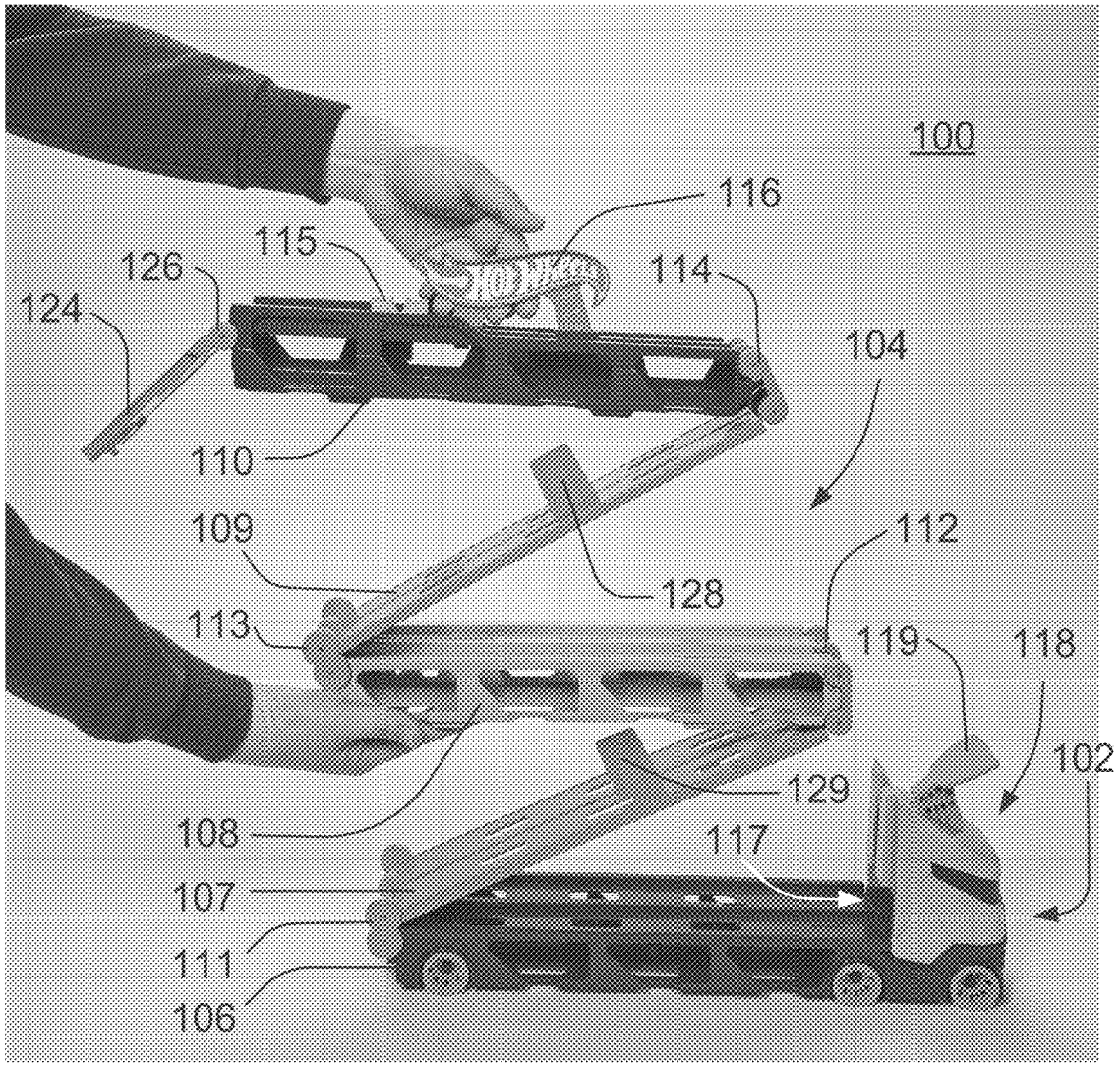
FIG. 3 illustrates the toy vehicle hauler of FIG. 2 with the stored toy vehicles removed, in accordance with an embodiment of the invention.

Toy vehicle hauler 100 can be transformed into a raceway configuration B (see FIG. 4) by unfolding and expanding trailer sections 106-110 to form a straight track 130. As shown in FIGS. 2 and 3, the stacked trailer sections 106-110 are unfolded by lifting trailer sections 106-110 away from the cabin portion 102. Having trailer sections 106-110 folded in a zigzag pattern allows toy vehicle hauler 100 to be transformed to its raceway configuration B in a single motion that is quick and simple for a user such as a child. A handle 116 is further provided on the top of storage section 110 to allow a user to lift and reposition trailer sections 106-110 more easily. Toy vehicles 121 may be kept within storage sections 106, 108, 110 while toy vehicle hauler 100 is being transformed between transport configuration A and raceway configuration B (see FIG. 2) or removed from toy vehicle hauler 100 (see FIG. 3).

Each bridge section 107, 109 further has a support 128, 129 on an underside or bottom of the bridge section. Supports 128, 129 help prop respective bridge sections 107, 109 and keep the top surfaces of bridge sections 107, 109 level with the top surfaces of storage sections 106, 108, 110 while toy vehicle hauler 100 is in the raceway configuration B (see FIG. 4). While bridge sections 107, 109 are folded in the transport configuration A, the underside of bridge sections 107, 109 and respective supports 128, 129 are oriented upwards (see, e.g., FIG. 3). Each storage section 106, 108, 110 has an opening (not shown) on an underside or bottom of the storage section for receiving a respective support 128, 129 while the trailer sections 106-110 are stacked on top of each other in the transport configuration A. Thus, an alternating arrangement of storage and bridge sections is necessary so that each support 128, 129 of bridge sections 107, 109 has access to a corresponding opening on the bottom of a storage section.

Figure 4:
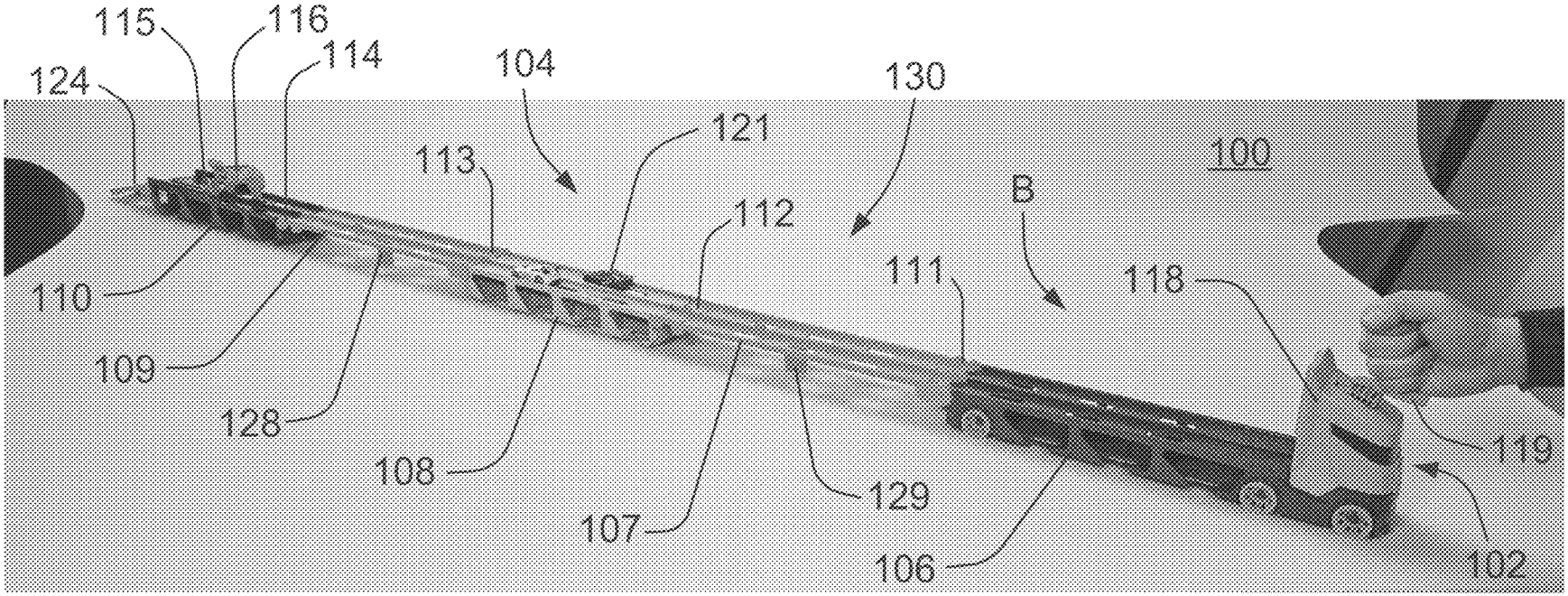
FIG. 4 illustrates the toy vehicle hauler of FIG. 1 in its raceway configuration, in accordance with an embodiment of the invention.

FIG. 4 shows toy vehicle hauler 100 fully transformed to a raceway configuration B where trailer sections 106-110 are unfolded to form a straight track 130. Straight track 130 comprises storage sections 106, 108, 110 and the bridge sections 107, 109 coupled end-to-end in an arrangement that alternates between storage sections 106, 108, 110 and bridge sections 107, 109. Bridge sections 107, 108 allow straight track 130 to be substantially longer than just having the three storage sections 106, 108, 110 coupled together in the raceway configuration B, while also minimizing the height increase due to the additional bridge sections when all the trailer sections 106-110 are folded on top of each other in the transport configuration A. Furthermore, hinges 112, 114 are shaped differently than hinges 111, 113 so that the top surfaces of bridge sections 107, 109 can be level with the top surfaces of storage sections 106, 108, 110 when trailer sections 106-110 are expanded in the raceway configuration B. Straight track 130 includes two parallel track lanes that allow two toy vehicles 121 to race against each other side-by-side. Additionally, a ramp 124 is pivotably coupled via hinge 126 to the end of storage section 110 (see FIG. 2). Ramp 124 allows the toy vehicles that are traveling on straight track 130 to smoothly transition from straight track 130 unto the floor or a surface supporting toy vehicle hauler 100. Furthermore, the top of storage section 110 includes a rotatable diverter 115 that is used to show the winner of a race. Before racing toy vehicles across straight track 130, a user first positions diverter 115 transversely to straight track 130. As two toy vehicles are raced side-by-side along straight track 130, the faster toy vehicle will be the first to contact diverter 115 and cause diverter 115 to rotate, thereby signifying the winner of the race.

Cabin portion 102 includes a toy vehicle launcher 118 that is positioned to launch toy vehicles onto and along straight track 130. As shown in FIG. 3, launcher 118 has an opening 117 that is exposed when toy vehicle hauler 100 is transformed into its raceway configuration B. Opening 117 is sized to accommodate the launching of two toy vehicles simultaneously onto storage section 106. Launcher 118 has an actuator 119 that causes launcher 118 to launch toy vehicles when a user pivots actuator 119 downwards toward cabin portion 102. Other types of toy vehicle launchers with different launching mechanisms may also be used, for example spring-loaded launchers.

Toy vehicle hauler 100 can be transformed from raceway configuration B back to transport configuration A by lifting trailer sections 106-110 towards cabin portion 102 using handle 116 and folding trailer sections 106-110 together one on top of the other in a zigzag pattern. Hinges 111-114 ensure trailer sections 106-110 are folded correctly when transforming back to transport configuration A. Furthermore, the length of ramp 124 is less than the height of the stacked trailer sections 106-110 (see FIG. 1) so that ramp 124 does not obstruct the movement of toy vehicle hauler 100 while in the transport configuration A.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims.

Moreover, it is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" may be used herein to describe an example or illustration. Any embodiment described herein as exemplary is not to be construed as a preferred or advantageous embodiment, but rather as one example or illustration of a possible embodiment of the invention. Finally, various features from one of the embodiments may be incorporated into another of the embodiments.

The invention claimed is:

1. A transformable toy vehicle hauler comprising:

a trailer portion, the trailer portion including three or more trailer sections pivotably coupled end-to-end, wherein each of the three or more trailer sections includes a top surface and an opposite bottom surface, and wherein at least one of the three or more trailer sections further includes a hollow space disposed between the top surface and the bottom surface, the hollow space being configured to store a toy vehicle; and a cabin portion connected to the trailer portion, the cabin portion including a toy vehicle launcher;

wherein the toy vehicle hauler is capable of being configured in a transport configuration, where the three or more trailer sections are folded together in a zigzag pattern, and a raceway configuration, where the three or more trailer sections are unfolded to form a straight track.

2. The transformable toy vehicle hauler of claim 1, wherein the three or more trailer sections are stacked on top of one another while the toy vehicle hauler is in the transport configuration.

3. The transformable toy vehicle hauler of claim 1, wherein the three or more trailer sections are positioned linearly end-to-end while the toy vehicle hauler is in the raceway configuration.

4. The transformable toy vehicle hauler of claim 1, wherein the cabin portion is connected to one of the trailer sections and the toy vehicle launcher is configured to launch one or more toy vehicles onto the trailer section connected to the cabin portion while the toy vehicle hauler is in the raceway configuration.

5. The transformable toy vehicle hauler of claim 4, wherein the trailer section connected to the cabin portion includes rotatable wheels.

6. The transformable toy vehicle hauler of claim 1, wherein the cabin portion further includes a pivotable actuator for activating the toy vehicle launcher.

7. The transformable toy vehicle hauler of claim 1, wherein the trailer portion further includes a ramp pivotably coupled to one of the trailer sections.

8. The transformable toy vehicle hauler of claim 1, wherein the trailer sections of the trailer portion each include two parallel track lanes.

9. A toy vehicle hauler comprising:

a trailer portion, the trailer portion including two or more storage sections and one or more bridge sections, wherein the two or more storage sections and the one or more bridge sections are pivotably coupled end-to-end in an arrangement that alternates between the storage sections and bridge sections, and wherein each of the two more storage sections contain a top surface, an opposite bottom surface, and at least one hollow space disposed between the top surface and the bottom surface, the at least one hollow space being configured to store one or more toy vehicles, and each of the one or more bridge sections contain a top surface and an opposite bottom surface; and a cabin portion connected to the trailer portion, the cabin portion including a toy vehicle launcher;

wherein the toy vehicle hauler is capable of being configured in a transport configuration, where the alternating arrangement of storage sections and bridge sections are folded together in a zigzag pattern, and a raceway configuration, where the alternating arrangement of storage sections and bridge sections are unfolded such that the bottom surface of the two or more storage sections is disposed on a support surface, and such that the top surface of each of the two or more storage sections and the top surface of each of the one or more bridge sections collectively form a straight track.

10. The toy vehicle hauler of claim 9, wherein the alternating arrangement of storage sections and bridge sections are stacked on top of one another while the toy vehicle hauler is in the transport configuration.

11. The toy vehicle hauler of claim 9, wherein the alternating arrangement of storage sections and bridge sections are positioned linearly end-to-end while the toy vehicle hauler is in the raceway configuration.

12. The toy vehicle hauler of claim 9, wherein the cabin portion is connected to one of the storage sections or bridge sections and the toy vehicle launcher is configured to launch one or more toy vehicles onto the storage section or bridge section connected to the cabin portion while the toy vehicle hauler is in the raceway configuration.

13. The toy vehicle hauler of claim 9, wherein the cabin portion further includes a pivotable actuator for activating the toy vehicle launcher.

14. The toy vehicle hauler of claim 9, wherein the trailer portion further includes a ramp pivotably coupled to one of the storage sections or bridge sections.

15. The toy vehicle hauler of claim 9, wherein the storage sections and the bridge sections of the trailer portion each include two parallel track lanes.

16. The toy vehicle hauler of claim 9, wherein each of the storage sections includes one or more openings disposed on opposing sides of each of the storage sections, the one or more openings being configured to provide access to the at least one hollow space.

17. The toy vehicle hauler of claim 9, wherein each bridge section includes a support on the bottom surface of the bridge section.

18. The toy vehicle hauler of claim 17, wherein each storage section includes an opening on the bottom surface of the storage section for receiving the support of a bridge section while the toy vehicle hauler is in the transport configuration.

19. A transformable toy vehicle hauler comprising:

a trailer portion, the trailer portion including three or more trailer sections pivotably coupled end-to-end, wherein each of the three or more trailer sections includes a top surface and an opposite bottom surface, and wherein at least one of the three or more trailer sections further includes a hollow space disposed between the top surface and the bottom surface, the hollow space being configured to store a toy vehicle; and a cabin portion connected to the trailer portion;

wherein the toy vehicle hauler includes rotatable wheels and is capable of being configured in a transport configuration and a raceway configuration, and wherein the three or more trailer sections are folded together on top of one another in a zigzag pattern in the transport configuration and the three or more trailer sections are positioned linearly end-to-end to form a straight track in the raceway configuration.

20. The transformable toy vehicle hauler of claim 19, wherein the cabin portion includes a toy vehicle launcher configured to apply a force to a toy vehicle to propel the toy vehicle onto one of the three or more trailer sections.

* * * * *